US005330018A

United States Patent [19]

Griffith

[11] Patent Number: 5,330,018

[45] Date of Patent: Jul. 19, 1994

[54] AUTO SET BI-DIRECTIONAL JAR

[76] Inventor: Jerry Griffith, 309 Wyman Rd., Scott, La. 70583

[21] Appl. No.: 58,870

[22] Filed: May 6, 1993

[51] Int. Cl.[5] ..... E21B 31/107

[52] U.S. Cl. ..... 175/299; 166/178

[58] Field of Search ..... 175/299, 293, 300, 304; 166/178

[56] References Cited

U.S. PATENT DOCUMENTS

| | | | |
|---|---|---|---|
| 2,634,102 | 4/1953 | Howard | 175/299 |
| 4,333,542 | 6/1982 | Taylor | 175/299 |
| 4,688,649 | 8/1987 | Buck | 175/299 |
| 4,844,157 | 7/1989 | Taylor | 166/178 |
| 4,846,273 | 7/1989 | Anderson | 166/178 |
| 4,865,125 | 9/1989 | De Cuir | 166/178 |
| 4,889,198 | 12/1989 | Buck | 175/304 |
| 5,139,086 | 8/1992 | Griffith, Sr. | 166/178 |

*Primary Examiner*—Thuy M. Bui

[57] ABSTRACT

An automatic set bi-directional apparatus for jarring an object in a well bore is disclosed. The apparatus comprises a tubular member having a portion defining an upper and lower striking shoulder, said tubular member having one end connected to a work string capable of creating a longitudinal force. A mandrel is connected to the object and the mandrel is concentrically disposed within said tubular member. The apparatus further includes a plurality of elongated members and an upper and lower ring members which serve as latch means. The mandrel further comprises a first and second grooved portion which are used for releasing the tubular member in order to deliver either an upward or downward jarring impact upon a stationary anvil.

17 Claims, 7 Drawing Sheets

AUTO SET BI-DIRECTIONAL JAR

BACKGROUND OF THE INVENTION

This invention relates to jars utilized in well bores. More particularly, but not by way of limitation, this invention relates to an auto set hi-directional jar that provides both an upward and downward jarring action to a mass in a well bore. After permitting the jarring of the mass, the apparatus of the present invention will be automatically positioned to provide a reciprocating jarring action.

In the drilling, completion or re-completion of a well, many times the operating string becomes lodged in the well bore. Once the string is lodged, or stuck as is commonly referred to those of ordinary skill in the art, the operator will require that the lodged object be freed. This process of freeing the stuck object is known as fishing.

Many different types of prior art devices have been utilized in the industry. Generally, these jars employ a moving mass impacting a stationary anvil. One of the first jarring devices can be seen in U. S. Pat. No. 2,122,751 to Kennedy. Another jar of the type utilizing a moving mass impacting an anvil can be seen in U. S. Pat. No. 2,122,751 to Phipps. Yet another jar is seen in U. S. Pat. No. 4,333,542 to Taylor. In U. S. Pat. No. 4,688,649 to Buck, the invention discloses a latching device utilized with a down hole jar.

In U. S. Pat. No. 5,139,086 by Griffith, the specification discloses a combined accelerator and jar for sudden release of accumulated energy, for delivering an up or down jarring impact. In this patent to Griffith, one of the problems solved by the invention over the prior art was the allowing of a jarring impact in either an upward or downward direction. Nevertheless, the operator must still "re-set" the jar in order to place the jar in a position to jar. All of the prior art jars share this difficulty of having to re-set the jar in order to impact the hammer on the anvil. This invention solves this problem by having a self-operating re-set design such that the jar, after firing, is automatically re-set.

SUMMARY OF THE INVENTION

The invention contains apparatus claims for a jarring apparatus comprising a cylindrical housing with hammer means for jarring an object in a well. A mandrel is slidably disposed within the housing to form a spring chamber. Also, the mandrel contains an anvil for receiving the impact from the hammer means.

The apparatus also contains latch means for latching the mandrel to the cylindrical housing. Biasing means are included for biasing the latch means in an engaged position within the housing. In one embodiment, the biasing means comprises frusto-conical disc springs capable of storing kinetic energy. The mandrel will have contained thereon a first and second releasing means for releasing the latch means thereby allowing the hammer to deliver an upper impact force to the anvil.

The mandrel will contain, in one embodiment, an internal and external shoulder. The anvil means, contained on the mandrel, will therefore comprise the external shoulder of the mandrel adapter to receive a downward impact from the hammer means. The anvil means further comprises the internal shoulder which is adapted to receive the hammer means for an upward jarring impact from the hammer means.

In one embodiment, the housing will contain an external and internal shoulder formed thereon. The hammer means, contained on the cylindrical housing, will therefore comprise the external shoulder of the housing adapted to downwardly impact the external shoulder of the mandrel, as well as the internal shoulder of the housing adapted to upwardly impact the internal shoulder of the mandrel.

The latch means will include in one embodiment, a plurality of latch bars, with the latch bars containing a first and second end, and a protuberance thereon, with the protuberance cooperating with the releasing means. The latch means also includes an upper ring for receiving the first end of the latch bar, and a lower ring for receiving the second end of the latch bar.

The latch bars are generally an elongated member with a first end and a second end, with the first end cooperating with the upper ring, and the second end cooperating with lower ring. The protuberance will have a first and second chamfered side.

The upper and lower ring contains a generally cylindrical member having a first end and second end, with the first end engaging the biasing means and the second end having an angled end with a leg member extending therefrom, with the angled end cooperating with said first end of the elongated member.

The automatic set bi-directional jar may also contain a biasing adjustment means, positioned within the housing, for adjusting the variable tension of the biasing means.

In the preferred embodiment, the distance from the first releasing means to the second releasing means is the length of the stroke of the jar. Also, the mandrel is tapered between the first releasing means to the second releasing means so that the latching means may expand as the housing is in motion during a jarring process. This allows free and unrestricted movement of the housing during the jarring operation.

A feature of the present invention includes the upper and lower releasing means which are contained on the mandrel. Another feature is that the housing means contains the hammer which allows for the housing to serve as the traveling mass which ultimately strikes the stationary anvil.

Another feature includes use of the inner mandrel as the stationary anvil means, with the mandrel being connected to the stuck object in the well bore. Still another feature includes the tapered mandrel which allows for the latch means to expand as the as the latch means travels with the hammer during jarring operation.

Another feature includes use of latch bars specially angled to complement the releasing means, as well as having upper and lower rings which are configured to have the latch bars engaged and cooperate therewith. Still another feature includes the spacing of the upper and lower releasing means being equal to the stroke of the jar.

An advantage of the present invention is that immediately upon jarring, the apparatus is reset and will be able to impact in a reciprocal direction. Another advantage is that the apparatus jars in a sequential pattern, in that the apparatus will impact up, then down, and so on. Yet another advantage is that the jar is particular suited for use in deep and highly deviated well bores.

DESCRIPTION OF THE PREFERRED EMBODIMENTS

Figure 1:
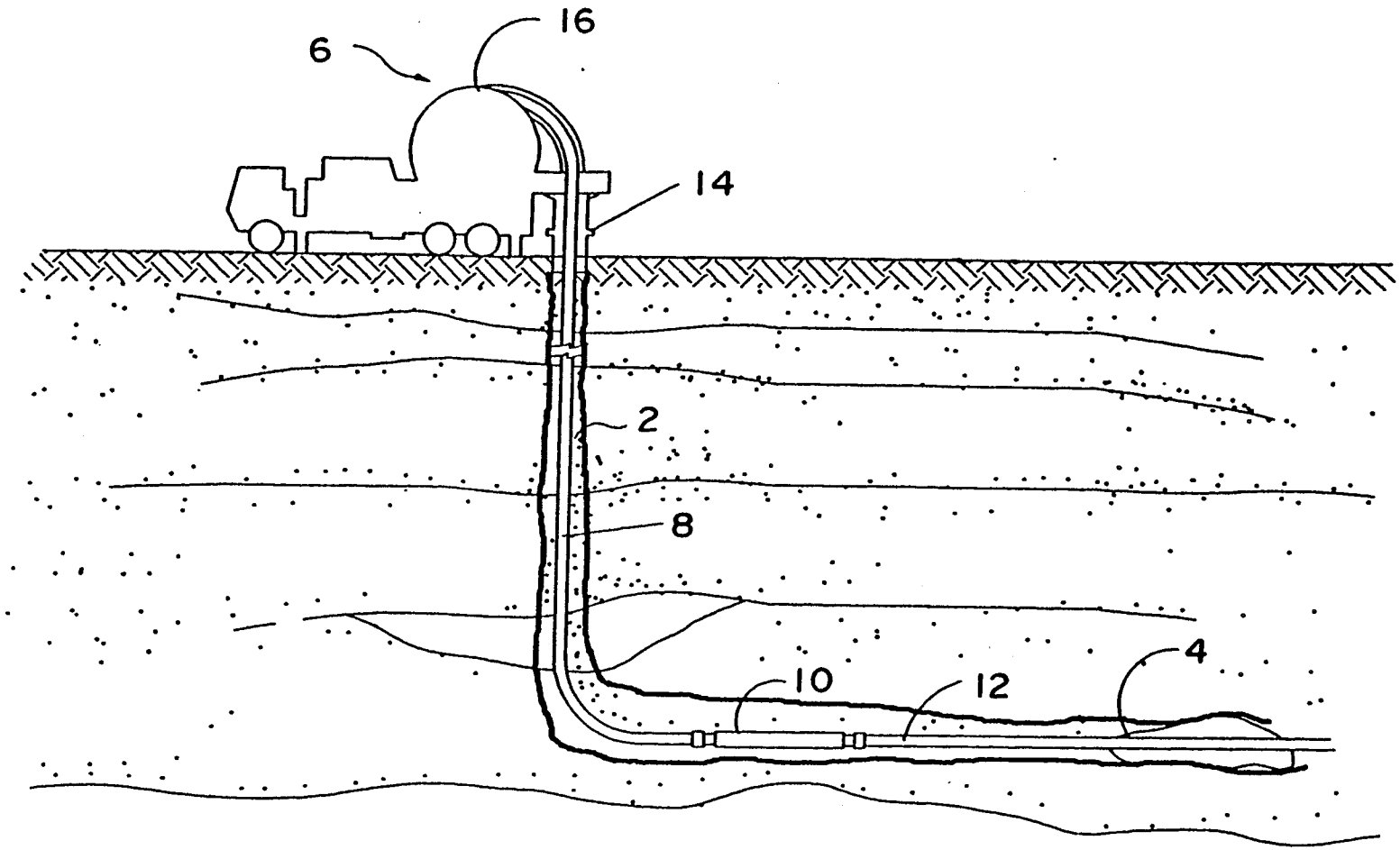
FIG. 1 is a schematic view depicting the invention being positioned within a well bore.

Like numbers in the various figures refer to like components of the invention. Referring to FIG. 1, a schematic view of the invention being positioned within a well bore 2 is depicted. The well bore is generally casing which has been set beneath the surface of the earth. The well bore will intersect differing types of geologic strata, and some of these reservoirs 4 will contain oil and gas which will later be produced.

At the surface, some type of drilling rig or remedial workover rig will be stationed. In FIG. 1, a typical coiled tubing unit 6 is shown. It should be understood that the apparatus of the present invention may be utilized with all types of works string such as drill pipe, wire line, electric line, etc.

The work string 8, which in FIG. 1 is coiled tubing, will have attached thereto the automatic set bi-directional jar 10. The jar will be attached to an object 12 within the well bore. This object may be a stuck pipe. The object may also be some type of down hole tool which requires a jarring action to either engage or disengage the tool in the well bore 2. The coiled tubing 8 is fitted through the tubing head 14, and stored on the tubing reel 16.

Figure 2A:
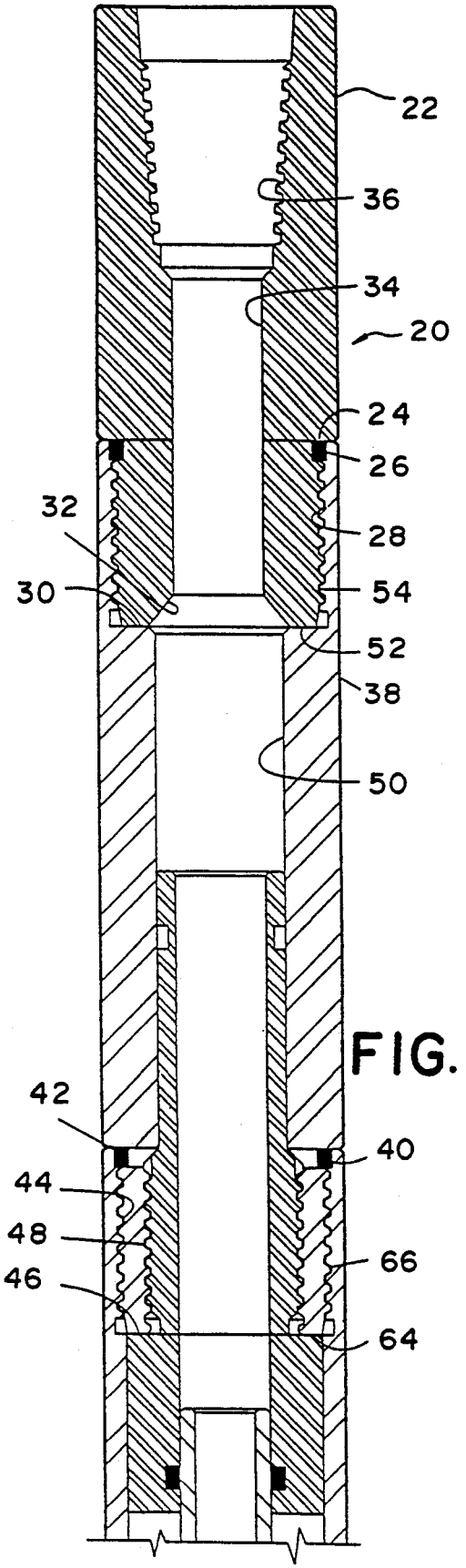
FIGS. 2E-2E is a sectional view of the invention when engaged to deliver a downward impact.

Referring to FIG. 2A, the apparatus of the present invention will now be described. The cylindrical housing, seen generally at 20, comprises a first outer surface 22 that extends to radial shoulder 24, which in turn terminates at cylindrical surface 26, with surface 26 containing thereon external thread means 28. Extending radially inward of thread means 28 is radial surface 30, and extending therefrom is chamfered surface 32, and internal bore 34, with the bore 32 terminating at the internal thread means 36.

The cylindrical housing 20 also contains a second section having a second outer surface 38 that extends to shoulder 40, with shoulder 40 terminating at surface 42, with the surface 42 having contained thereon external thread means 44 that terminate at radial surface 46. Extending internally thereof is internal threads 48, with the threads terminating at bore surface 50. The bore surface terminates at the shoulder 52. Extending from the shoulder 52 is internal threads 54.

The housing 20 will contain a third outer surface 56 that extends to shoulder 58, with the shoulder 58 extending radially inward to internal thread means 60 and internal cylindrical surface 62 that terminates at shoulder 64. The shoulder 64 will extend to internal thread means 66 and will be secured to threads 44.

The fourth outer cylindrical surface 68 will extend to the shoulder 70, and extending radially inward will be the internal thread means 72, which in turn will continue to internal bore 74, and will terminate at shoulder 76.

Figure 2B:
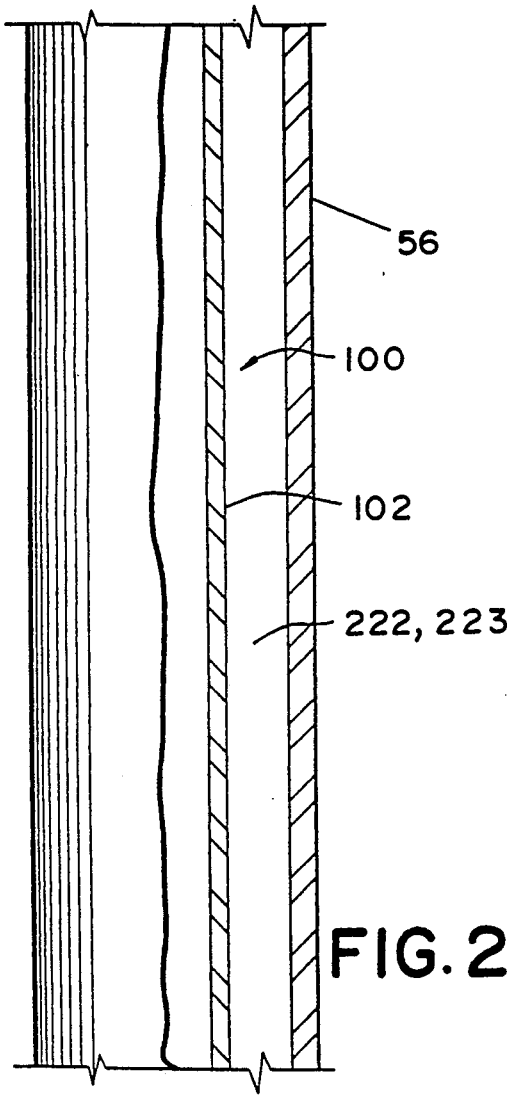
Figure 2C:
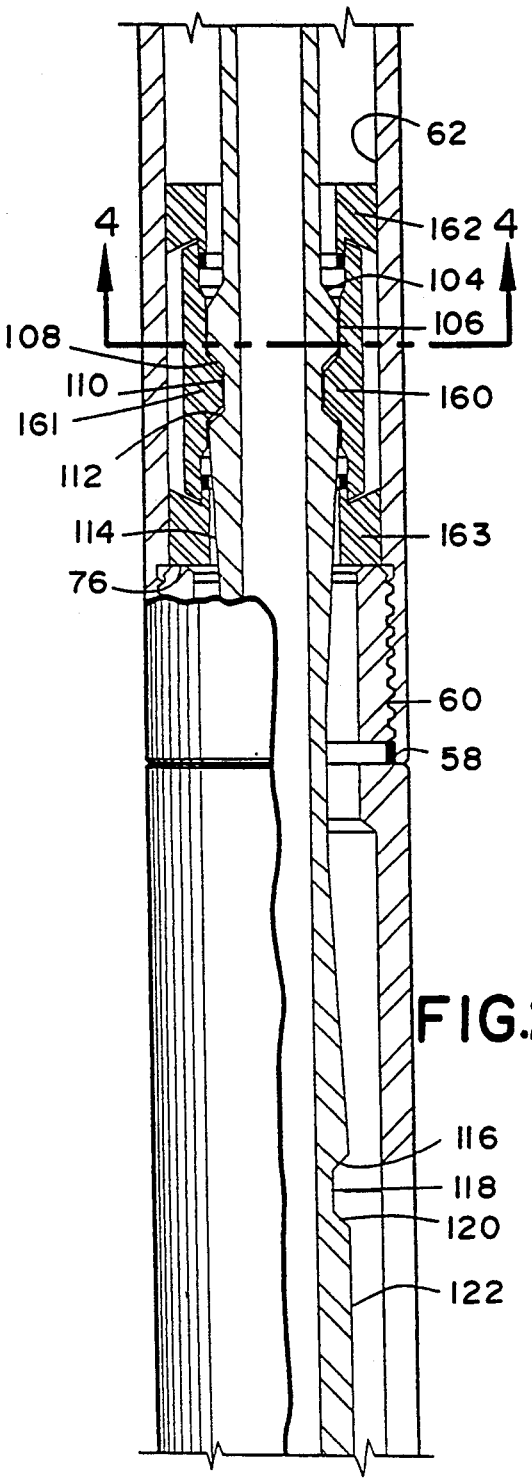
Figure 3C:
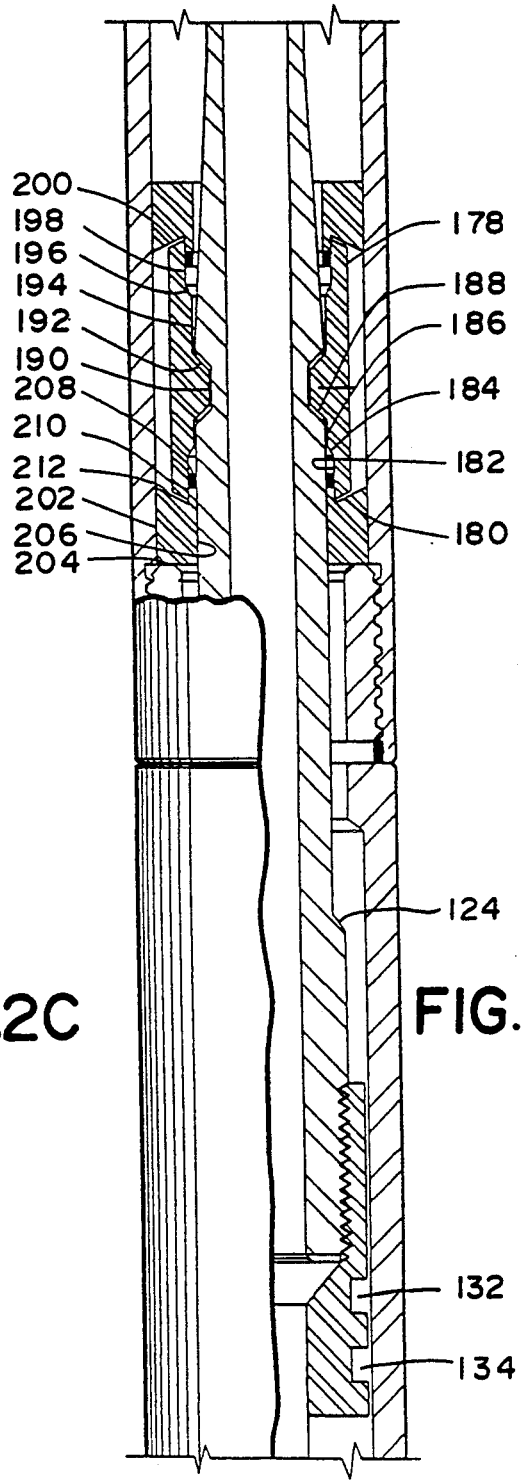
Figure 2D:
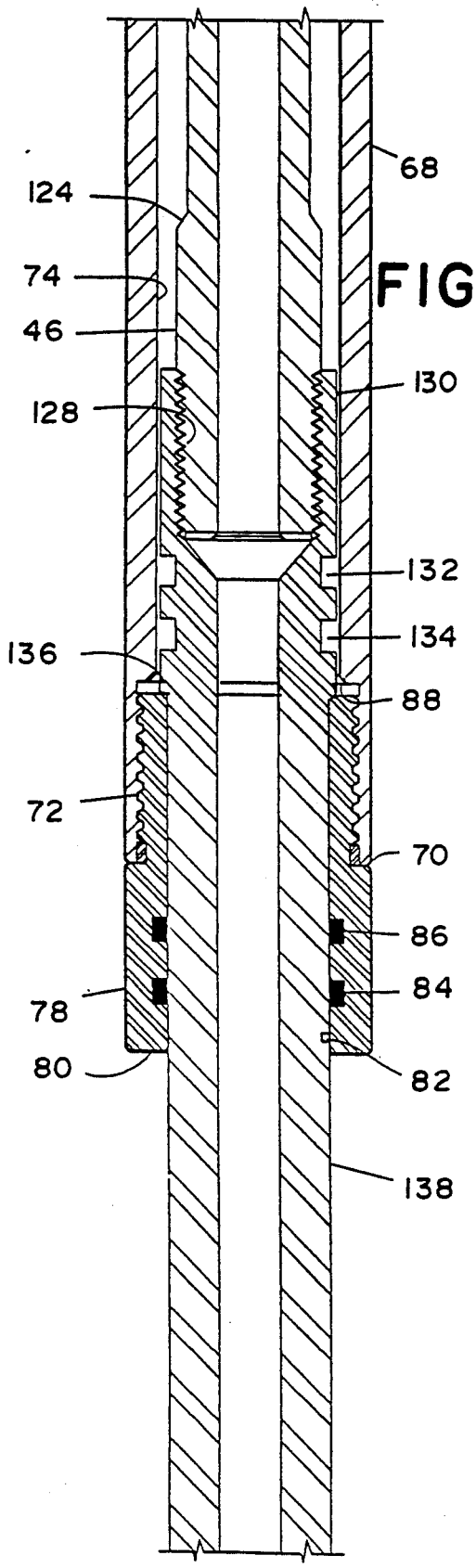
Figure 3D:
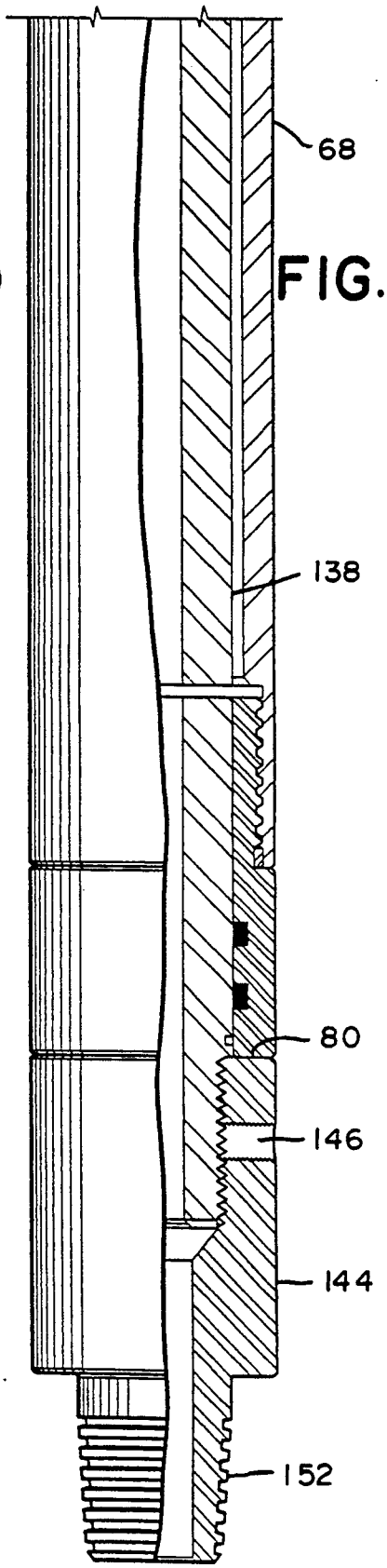

As seen in FIG. 2D, the housing will contain a fifth outer surface 78 that terminates at shoulder 80, and extending radially inward will be inner bore surface 82 that will have contained thereon seal means 84, and 86. The seal means will generally be an elastomeric member, such as an o-ring, fitted in a groove. The inner bore surface terminates at internal striking shoulder 88. It should be noted that the inner diameter of bore surface 82 is less than the inner diameter of bore surface 74.

The mandrel, seen generally at 100 in FIG. 2B, is concentrically disposed within the cylindrical housing. The mandrel has a releasing means that will comprise a first outer surface 102 that extends to angled shoulder 104, which in turn continues to second outer surface 106. The surface 106 terminates at angled surface 108, which then terminates at the third outer surface 110, such that a circular groove is formed about the mandrel, which in turn extends to the next angled surface 112. The angled surface then terminates at tapered outer surface 114.

The mandrel will also have contained thereon a second releasing means that comprises the previously mentioned tapered outer surface 114 as seen in FIG. 2C, and terminates at angled surface 116, with the surface 116 extending to the fifth outer surface 118 thereby forming a groove about the mandrel 100. The outer surface will continue to the angled surface 120, with the surface 120 terminating at the cylindrical sixth surface 122. The surface 122 terminates at chamfered shoulder 124, which in turn extends to seventh surface 126. The surface 126 will have contained thereon external thread means 128.

The mandrel 100 will also contain a second section as seen in FIG. 2D which has a first surface 130 that will include seal means 132, and 134, with the surface 130 terminating at anvil shoulder 136, which will cooperate with the striking shoulder 88, as will be more fully explained in the operation portion of the application. The anvil shoulder 136 terminates at the second surface 138, with the surface 138 extending to the external thread means 140.

The mandrel 100 will conclude with a third section which includes an external anvil shoulder 142 that will cooperate with, as will be more fully set-out in the operation of the invention, the shoulder 80. Anvil shoulder 142 extends to the cylindrical surface 144, with the surface 144 containing an aperture 146 for placement of a phillips screw in order to prevent the third section of the mandrel from dis-attaching from the external thread means 140. The surface 144 concludes at radial shoulder 148, with the radial shoulder terminating at surface 150, with the surface 150 containing external thread means 152.

Figure 2E:
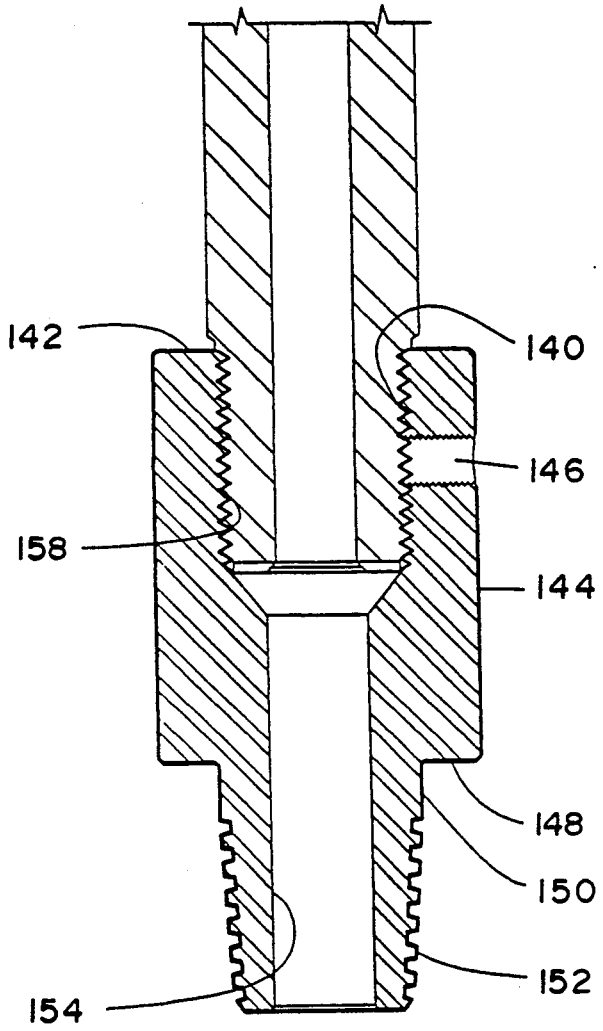
Figure 4:
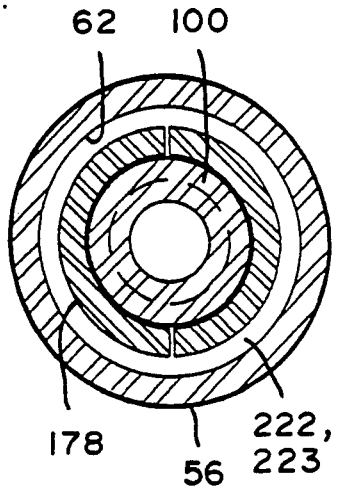
FIG. 4 is a cross-sectional view of the invention taken along line 4—4 of FIG. 2A.

As illustrated in FIG. 2E, extending radially inward of thread means 152 is the inner bore 154 that extends to chamfered surface 156, which in turn continues to internal thread means 158.

Figure 5:
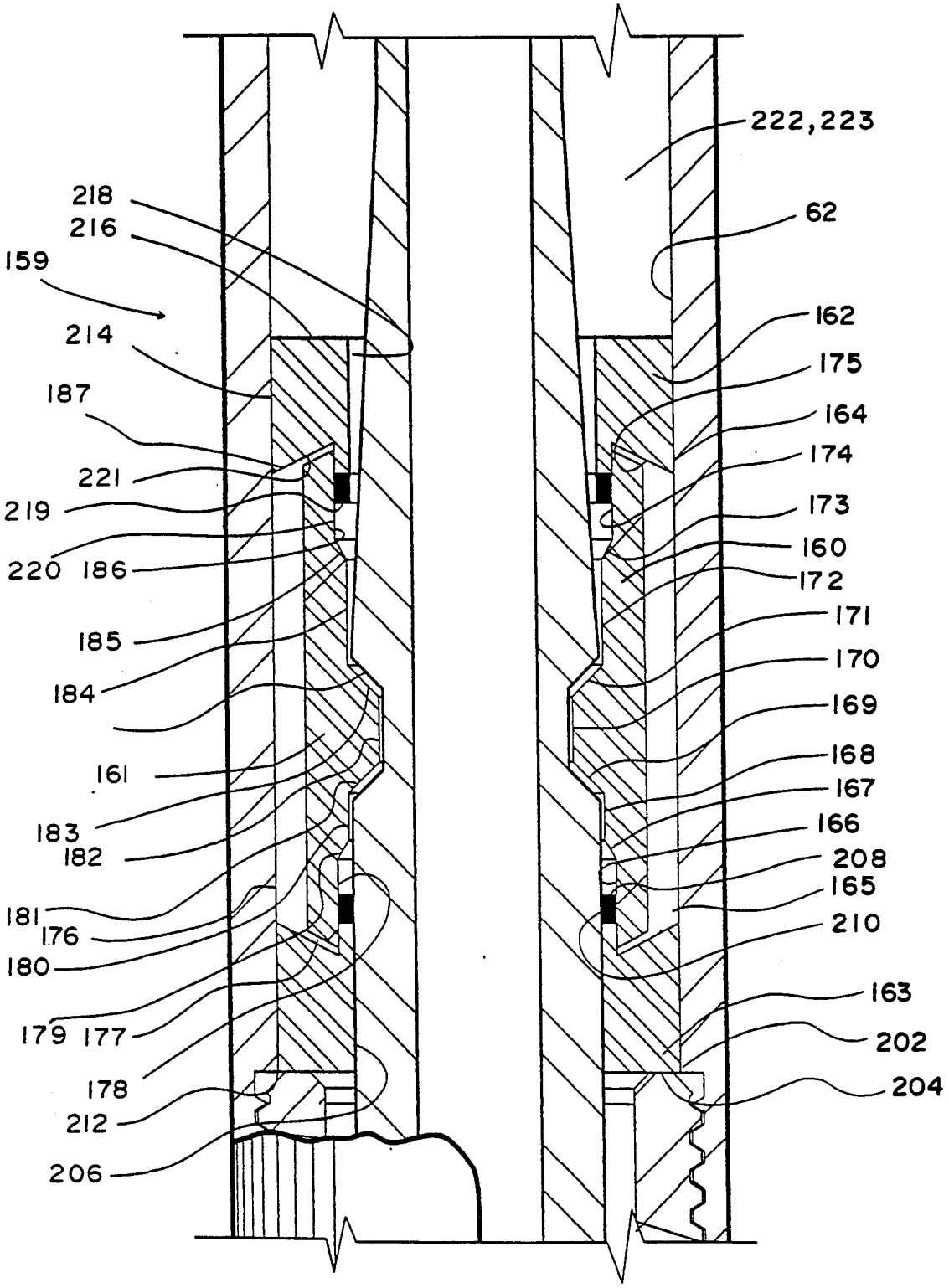
FIG. 5 is an enlarged sectional view of the latch means engaged in the first releasing means.

The latch means 159 will now be described. Reference is made to FIG. 5, which is an enlarged sectional view of the latch means 159. The latch means for latching the mandrel 100 in an engaged position within the housing 20 will be described. Generally, the latch means comprises a plurality of latch bar members 160, 161 and an upper cylindrical ring 162, and a lower cylindrical ring 163.

In the preferred embodiment, the plurality of latch bars will be of identical manufacture. The latch bar 160 will contain an outer surface 164 that terminates at the angled end 165. Extending radially inward of the angled end 165 is first surface 166 which in turn extends to angled shoulder 167, which in turn continues to second surface 168. The surface 168 terminates at angled surface 169, with the angled surface concluding at third surface 170, which in turn continues to angled surface 171. The surface 170, relative to the angled surfaces 169 and 171, forms a protuberance on the latch bar.

Extending from the angled surface 171 is the fourth surface 172, which in turn continues to the angled surface 173, which then continues to the surface 174, with surface 174 concluding at the angled end 175.

Latch bar member 161 generally comprises an outer cylindrical surface 176, that extends to angled surface 177, which in turn extends radially inward to first surface 178. First surface 178 extends to angled shoulder 179, which in turn extends to second surface 180, which terminates at angled surface 181, which continues to third surface 182. The third surface 182 terminates at angled surface 183 such that a protuberance is formed, with the surface 183 continuing to the fourth surface 184. The fourth surface terminates at angled surface 185, which in turn advances to the fifth surface 186, and then terminate at angled shoulder 187

The upper and lower cylindrical rings 162, 163, as seen in FIG. 5, will now be described. The upper and lower rings are generally symmetrical. The ring 163 will have an outer cylindrical surface 202 that concludes at radial surface 204. Extending radially inward from surface 204 is inner bore 206 which extends to opposing radial surface 208, which in turn terminates at the leg surface 210. The leg surface 210 continues to the angled surface 212, with the angled surface 212 continuing to the outer surface 202. As will more fully described in the operation of the invention, the latch bar angled ends 180 will cooperate with the leg surface 210 and angled surface 212 of the ring member.

The ring 162 will have an outer cylindrical surface 214 that terminates at radial surface 216, which in turn continues to inner bore 218. The inner bore 218 terminates at radial surface 219, which in turn advance to leg surface 220, which in turn advances to angled surface 221.

Referring again to FIG. 2B, the area between the mandrel 100 and the cylindrical housing 20 forms a spring chamber 222 for placement of biasing means for biasing the latch means in an engaged position within the housing. The biasing means used can be any variety known in the art including conical springs, belleville washers etc. As depicted, the belleville washers 223 are utilized, which are frusto-conical shaped dished washer springs capable of storing kinetic energy.

Figure 3A:
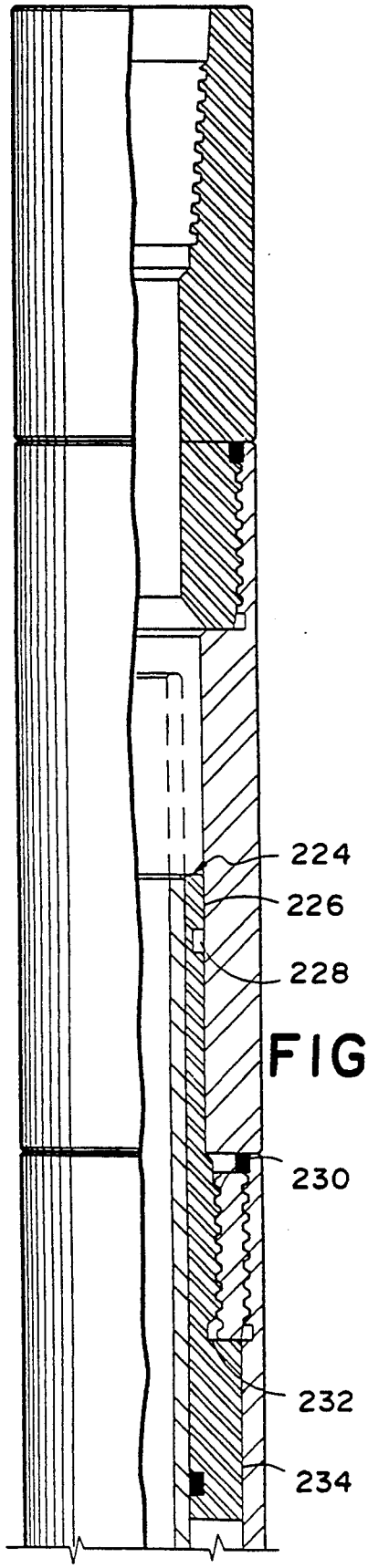
FIGS. 3A-3D is a sectional view of the invention when engaged to deliver an upward impact.

Referring to FIG. 3A, in the preferred embodiment, the invention will contain a biasing adjustment means, seen generally at 224, for adjusting the tension in the spring located in the spring chamber 220. The biasing adjusting means 224 will generally contain first cylindrical surface 226 that will have contained thereon seal means 228, as well as external thread means 230 that will cooperate with internal threads 48 of the housing member 20. The surface 226 concludes at radial shoulder 232, which in turn extends to second surface 234. The surface 234 concludes at radial surface 236, which in turn extends to internal bore 238. The internal bore 238 will have contained therein seal means 240 that will provide for a seal between the mandrel 100 and the biasing adjusting means 224.

Operation

Referring to FIG. 1, the jar 10 is run into the well bore 2 to the desired object 12 which is to be impacted. Note, that the object may be some type of stuck object, or alternatively, some type of down hole tool wherein it is desirable to have up and down jarring action.

The work string employed may be coiled tubing, drill pipe, wire line, electric line, etc. The jar will then be attached to the object with conventional means such as an over shot. The jar may be run into the well bore 2 in either the down stroke (illustrated in FIGS. 2A-2E) or up stroke (illustrated in FIGS. 3A-3D) position. For purposes of this description, assume that the jar is being run into the well bore 2 in the down stroke position, as illustrated in FIGS. 2A-E.

In FIG. 2E, the jar 10 will be attached via the thread means 152. Thus, the thread means 152, which forms a part of the mandrel 100 will be stationary relative to the object, as well as being attached to the object. The jar 10 is connected to the work string 8 by way of the internal thread means 36.

After having attached the mandrel 100 to the object 12, the operator will then begin slacking off the weight of the work string 8, which will in turn cause the housing 20 to move downward with the work string 8. As seen in FIG. 5, this will have the effect of compressing the spring biasing means 223, which will act against radial surface 216 of the upper cylindrical ring 162. The angled ends 165, 177 of the latch bars will then engage the angled surface 212 of the ring member 163. This will cause the angled surface 169, 181 of the protuberances 170, 182 of the latch bar 160, 161 to engage with the angled surface 112 of the releasing means. Note that the combination of the latch bar angled ends 165, 177, 187, 175 engaging with the cylindrical ring surfaces 221, 212 and being held in place by the leg surfaces 210, 220 will hold the latch bar in the engaged position until a sufficient amount of force is applied that will force the protuberance 170,182 past the groove 110.

Once the latch bar protuberance 170, 182 is freed from the engagement, the housing will begin its downward movement. Thus, the latch bars 160, 161 will be allowed to expand radially outward, thereby releasing the housing from the mandrel. As the housing 20 moves downward relative to the mandrel 100, the taper in the mandrel 100 will allow for a less restrictive movement about the mandrel because the latch bars will be allowed to expand. Continued movement of the housing 20 will result in the shoulder 80 impacting the anvil shoulder 142, which in effect will jar the object 12.

The distance between the surface 110 and 118, which are the two grooves formed on the mandrel 100, is equal to the distance of the stroke of the jar. In other words, the distance between the two grooves is equal to the distance from shoulder 80 to anvil shoulder 142 when the jar is in the downward jar position, as shown in FIG. 2. When the jar is in the upstroke position, the distance is equal to the anvil shoulder 136 and the striking shoulder 88.

Figure 3B:
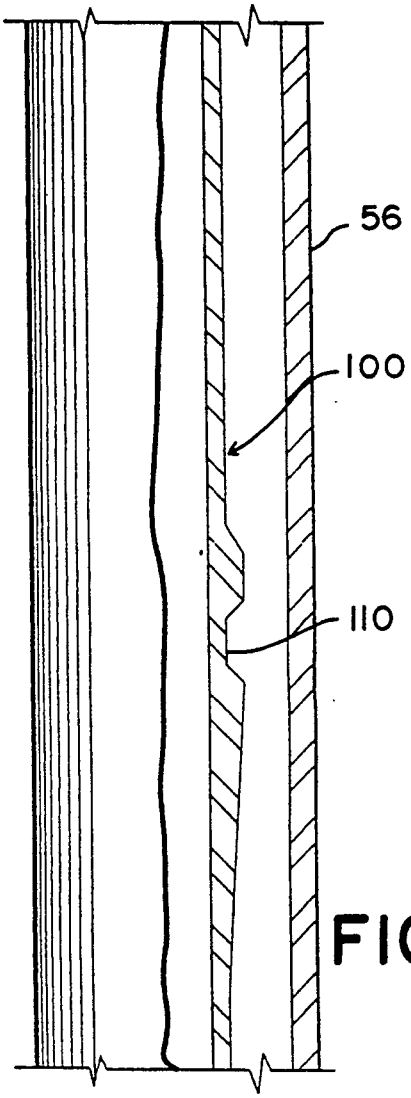

Thus, at the down stroke position, the latch bars 160, 161, and in particular the protuberances 170, 182 will be engaged in the groove 118 as seen in FIG. 3B In the upstroke position, the latch bars 160, 161 and in particular the protuberances 170, 182 will be engaged in the groove 110 as seen in FIG. 2C.

In order for the jar to have a reciprocal upward jar, the operator will have to cause an upward pull of the work string 8. Thus, the housing 20 will be pulled upward. This will cause the angled surfaces 175, 187 of the latch bar members 160, 161 to engage the angled surface 108 of the mandrel 100. Also, the continued upward pull of the work string 8 will cause the lower cylindrical ring 163 to engage the angled end 165, 177 of the latch bars 160, 161, with the leg surface 210 of the lower cylindrical ring 163 tending to engage the protuberance 170, 182 in the groove 118.

After sufficient force has been applied, the protuberance 170, 182 will disengage from the groove 118. Put another way, the angled surface 169, 181 will be forced by angled surface 116, thereby freeing the housing member 20. The striking shoulder 88 will travel rapidly and strike the anvil shoulder 136.

After having induced an upward stroke, the latch means, and in particular the latch bars members 160 and 161 will again be positioned in the position shown in FIG. 2C. At this point, the operation is the same as heretofore described. Hence, the operator will slack off weight of the work string, thereby compressing the spring biasing means 223, which in turn will cause the upper cylindrical member 162 to bear down on the latch bar members 160, 162, until sufficient amount of force is applied thereby allowing the protuberance 170, 182 past the angled surface 112.

Changes and modifications in the specifically described embodiments can be carried out without departing from the scope of the invention which is intended to be limited only by the scope of the appended claims.

I claim:

1. A jarring apparatus, comprising:

a cylindrical housing containing hammer means;

a mandrel slidably disposed within said housing to form a spring chamber, said mandrel containing anvil means;

latch means for latching said mandrel to said cylindrical housing;

biasing means, positioned within the spring chamber, for biasing said latch means in an engaged position within said housing;

and wherein said mandrel further contains:

first releasing means for releasing said latch means and allowing said hammer means to deliver an upper impact to said anvil means; and second releasing means for releasing said latch means and allowing said hammer means to deliver a downward impact to said anvil means.

2. The jar of claim 1 wherein said mandrel contains:

an internal and external shoulder;

and wherein said anvil means comprises:

said external shoulder of said mandrel adapted to receive a downward impact from said hammer means;

and, said internal shoulder of said mandrel adapted to receive an upward impact from said hammer means.

3. The jar of claim 2 wherein said housing contains:

an internal and external shoulder;

and wherein said hammer means comprises:

said external shoulder of said housing adapted to downwardly impact said external shoulder of said mandrel;

and, said internal shoulder of said housing adapted to upwardly impact said internal shoulder of said mandrel.

4. The jar of claim 3 wherein said latching means comprises:

a plurality of latch bars, said latch bar containing a first and second end, and a protuberance thereon, said protuberance having a first and second chamfered sides, said protuberance cooperating with said first and second releasing means; and an upper ring receiving said first end of said latch bar; a lower ring receiving said second end of said latch bar; and wherein biasing means biases against the upper ring.

5. The jar of claim 4 wherein the biasing means comprises frusto-conical disc springs capable of storing kinetic energy.

6. The jar of claim 5 further comprising a biasing adjustment means, positioned within said housing, for adjusting the kinetic energy of said conical disc springs.

7. The jar of claim 6 wherein said upper ring comprises:

a cylindrical member having a first end and second end, said first end engaging said biasing means and said second end having an angled end with a leg member extending therefrom, with said angled end cooperating with said first end of said elongated member.

8. The jar of claim 7 wherein said lower ring comprises:

a cylindrical member having a first end and a second end, said first end engaging a second internal shoulder located on said housing and said second end having an angled end with a leg member extending therefrom, with said angled end cooperating with said second end of said elongated member.

9. The jar of claim 7 wherein the distance from the first releasing means to the second releasing means is the length of the stroke of the jar.

10. The jar of claim 7 wherein said mandrel is tapered between the first releasing means and the second releasing means.

11. An automatic set bi-directional apparatus for jarring an object in a well bore, comprising:

a tubular member having a portion defining an upper and lower striking shoulder, said tubular member having one end connected to a work string capable of creating a longitudinal force;

a mandrel concentrically disposed within said tubular member, said mandrel having a first end and a second end, said second end being connected to the object, said mandrel containing an upper shoulder, and lower shoulder;

latch means for latching said housing to said mandrel;

a spring disposed about said mandrel and cooperating with said latch means;

upper releasing means, located on said mandrel, for releasing said tubular member so that said lower striker shoulder strikes said lower shoulder of said mandrel;

lower releasing means, located on said mandrel, for releasing said tubular member so that said upper striking shoulder strikes said upper shoulder of said mandrel; and engaging means for engaging said latch means with said upper and lower releasing means.

12. The apparatus of claim 11, wherein said latch means comprises:

a plurality of elongated members, said members containing a first chamfered end, a second chamfered end, and a protuberance, with said first and second chamfered end cooperating with said engaging means and said protuberance cooperating with said upper releasing means so that said protuberance is engaged with said upper releasing means.

13. The apparatus of claim 12, wherein said engaging means comprises:

an upper cylindrical ring, disposed about said mandrel, said upper ring having a first surface engaging said spring and a second surface engaging said first chamfered end of said elongated member; and a lower cylindrical ring, disposed about said mandrel, said lower ring having a first surface engaging an internal shoulder of said housing and a second surface engaging said second chamfered end of said elongated member.

14. The apparatus of claim 13, wherein said protuberance has a first and second angled surface, and wherein said upper releasing means comprises:

a portion of said mandrel having an upper groove with a first and second angled side so that said first and second angled surface of said protuberance cooperates with the complementary first and second angled side of said groove;

and wherein said lower releasing means comprises:

a portion of said mandrel having a lower groove with a first and second angled side so that said first and second angled surface of said protuberance cooperates with the complementary first and second angled side of said groove.

15. The apparatus of claim 14, further comprising a biasing adjustment means, positioned within said tubular member, for adjusting the tension in the spring.

16. The apparatus of claim 15 wherein the distance from the upper releasing means to the lower releasing means is the length of the stroke of the apparatus.

17. The apparatus of claim 16 wherein said mandrel is tapered between the upper and lower releasing means so that said elongated members can expand upon release from said releasing means.

* * * * *